US011667865B2

(12) United States Patent
Gill et al.

(10) Patent No.: US 11,667,865 B2
(45) **Date of Patent: *Jun. 6, 2023**

(54) MARINE DIESEL LUBRICANT OIL COMPOSITIONS HAVING IMPROVED LOW TEMPERATURE PERFORMANCE

(71) Applicants: Chevron Oronite Company LLC, San Ramon, CA (US); Chevron Oronite Technology B.V., San Ramon, CA (US)

(72) Inventors: Mia Gill, Novato, CA (US); Wilhelmus Petrus Antonie van Houten, Prinsenbeek (NL)

(73) Assignees: Chevron Oronite Company LLC, San Ramon, CA (US); Chevron Oronite Technology B.V., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/407,777

(22) Filed: Aug. 20, 2021

(65) Prior Publication Data

US 2022/0177802 A1 Jun. 9, 2022

Related U.S. Application Data

(63) Continuation of application No. 16/021,130, filed on Jun. 28, 2018, now abandoned.

(60) Provisional application No. 62/527,349, filed on Jun. 30, 2017.

(51) Int. Cl.

| | |
|---|---|
| ***C10M 129/10*** | (2006.01) |
| ***C10M 159/22*** | (2006.01) |
| *C10N 30/02* | (2006.01) |
| *C10N 30/04* | (2006.01) |
| *C10N 30/06* | (2006.01) |
| *C10N 30/12* | (2006.01) |
| *C10N 30/18* | (2006.01) |
| *C10N 30/00* | (2006.01) |
| *C10N 40/25* | (2006.01) |
| *C10N 40/26* | (2006.01) |

(52) U.S. Cl.

CPC ..... *C10M 129/10* (2013.01); *C10M 159/22* (2013.01); *C10M 2203/1025* (2013.01); *C10M 2207/028* (2013.01); *C10M 2207/262* (2013.01); *C10M 2215/06* (2013.01); *C10M 2215/28* (2013.01); *C10M 2219/046* (2013.01); *C10M 2223/045* (2013.01); *C10N 2030/02* (2013.01); *C10N 2030/04* (2013.01); *C10N 2030/06* (2013.01); *C10N 2030/12* (2013.01); *C10N 2030/18* (2013.01); *C10N 2030/52* (2020.05); *C10N 2040/252* (2020.05); *C10N 2040/26* (2013.01)

(58) Field of Classification Search

CPC ..... C10N 2040/25; C10M 159/22; C10M 2215/28; C10M 2215/26; C10M 2223/045; C10M 2203/1025; C10M 2203/1006; C10M 2207/028; C10M 2219/044; C10M 2207/26; C10M 2207/262; C10M 2205/026

See application file for complete search history.

(56) References Cited

U.S. PATENT DOCUMENTS

| | | | | |
|---|---|---|---|---|
| 2009/0170737 | A1* | 7/2009 | Campbell | C10M 159/20 508/460 |
| 2014/0235516 | A1* | 8/2014 | Lancon | C10M 161/00 508/370 |
| 2015/0126421 | A1* | 5/2015 | Boons | C10M 141/08 508/391 |

* cited by examiner

*Primary Examiner* — Vishal V Vasisth

(74) *Attorney, Agent, or Firm* — Hunton Andrews Kurth LLP

(57) ABSTRACT

A method for improving low temperature performance of a lubricant in a compression-ignited internal combustion engine is disclosed. The method comprises operating the engine with a monograde lubricating oil composition comprising (a) a major amount of a base oil of lubricating viscosity; and (b) a minor amount of an overbased alkaline earth metal salt of an alkyl-substituted hydroxyaromatic compound, the alkyl substituent being a residue derived from an isomerized alpha-olefin having from 12 to 40 carbon atoms per molecule.

12 Claims, No Drawings

MARINE DIESEL LUBRICANT OIL COMPOSITIONS HAVING IMPROVED LOW TEMPERATURE PERFORMANCE

CROSS-REFERENCE TO RELATED APPLICATIONS

This application is a CON of 16/021,130 filed Jun. 28, 2018, now abandoned which claims benefit of 62/527,349 filed Jun. 30, 2017.

TECHNICAL FIELD

This disclosure relates to methods for improving low temperature performance of lubricating oils operating in compression-ignited internal combustion engines.

BACKGROUND

Marine diesel internal combustion engines may generally be classified as low-speed, medium-speed, or high-speed engines. Low-speed diesel engines are unique in size and method of operation. These engines are quite large and typically operate in the range of about 60 to 200 revolutions per minute (rpm). A low-speed diesel engine operates on the two-stroke cycle and is typically a direct-coupled and direct-reversing engine of "crosshead" construction, with a diaphragm and one or more stuffing boxes separating the power cylinders from the crankcase to prevent combustion products from entering the crankcase and mixing with the crankcase oil. Marine two-stroke diesel cylinder lubricants must meet performance demands in order to comply with severe operating conditions required for more modern larger bore engines which are run at significantly varying outputs, loads and temperatures of the cylinder liner. The complete separation of the crankcase from the combustion zone has led persons skilled in the art to lubricate the combustion chamber and the crankcase with different lubricating oils, a cylinder lubricant and a system oil respectively, due to the unique requirements of each type of lubricant.

In two-stroke crosshead engines, the cylinders are lubricated on a total loss basis with the cylinder oil being injected separately on each cylinder, by means of lubricators positioned around the cylinder liner. Cylinder lubricant is not recirculated and is combusted along with the fuel. The cylinder lubricant needs to provide a strong film between the cylinder liner and the piston rings for sufficient lubrication of the cylinder walls to prevent scuffing, be thermally stable in order that the lubricant does not form deposits on the hot surfaces of the piston and the piston rings, and be able to neutralize sulfur-based acidic products of combustion.

The system oil lubricates the crankshaft and the crosshead of a two-stroke engine. It lubricates the main bearings, the crosshead bearings, gears and the camshaft and it cools the piston undercrown and protects the crankcase against corrosion. A system oil needs to be able to prevent corrosion of metal in the bearing shells and to prevent rust in the crankcase when in the presence of contaminated water. The system oil also needs to provide adequate hydrodynamic lubrication of the bearings and have an anti-wear system sufficient to provide wear protection to the bearings and gears under extreme pressure conditions. In contrast to a cylinder lubricant, system oil is not exposed to the combustion chamber where fuels are being combusted and is formulated to last as long as possible to maximize the lifetime of the oil. Therefore, the primary performance characteristics of system oils are related to wear protection, oxidative stability, viscosity increase control and deposit performance.

Medium-speed engines, typically operate in the range of about 250 to 1100 rpm and operate on the four-stroke cycle. These engines are typically of the trunk piston design. In trunk piston engines, a single lubricating oil is employed for lubrication of all areas of the engine, as opposed to the crosshead engines. A trunk piston engine oil therefore has unique requirements. Key performance parameters for operating trunk piston engines include: deposit control of the piston cooling gallery and piston ring pack, oxidation and viscosity increase control, demulsibility performance and sludge control. For marine residual fuels operation, these performance parameters are almost exclusively driven by asphaltenes contamination from marine residual fuels.

Recent health and environmental concerns, have led to regulations mandating the use of low sulfur fuels for the operation of marine diesel engines. As a result, manufacturers are now designing marine diesel engines for use with a variety of fuels including non-residual gaseous fuels (e.g., compressed or liquefied natural gas) and high quality distillate fuel, to poorer quality intermediate or heavy fuel such as marine residual fuel with generally higher sulfur and higher asphaltene content. For non-residual fuel operation, the fuel contains no significant asphaltenes present in the fuels and contains much lower sulfur levels. When the lower sulfur fuel is combusted, less acid is formed in the combustion chamber. The requirements for lubricants used for the operation of engines using low sulfur gaseous and distillate fuels versus marine residual fuels are very different.

In view of restrictive emissions regulations, and changing fuel sources and operating conditions for marine diesel internal combustion engines, there is continuing need for improved marine diesel lubricating oil additive technology.

SUMMARY

In one aspect, there is provided a method for improving low temperature performance of a lubricant in a compression-ignited internal combustion engine, the method comprising operating the engine with a lubricating oil composition comprising (a) greater than 50 wt. % of a base oil of lubricating viscosity; and (b) 0.1 to 40 wt. % of an overbased alkaline earth metal salt of an alkyl-substituted hydroxyaromatic compound, wherein the alkyl substituent is a residue derived from an isomerized alpha-olefin having from 12 to 40 carbon atoms per molecule; wherein the lubricating oil composition is a monograde lubricating oil composition meeting specifications for SAE J300 revised January 2015 requirements for a SAE 20, 30, 40, 50, or 60 monograde engine oil, and has a TBN of 5 to 200 mg KOH/g, as determined by ASTM D2896.

DETAILED DESCRIPTION

Introduction

In this specification, the following words and expressions, if and when used, have the meanings ascribed below.

A "major amount" means greater than 50 wt. % of a composition.

A "minor amount" means less than 50 wt. % of a composition.

An "alpha-olefin" as used in this specification and claims refers to an olefin that has a carbon-carbon double bond between the first and second carbon atoms of the longest contiguous chain of carbon atoms. The term "alpha-olefin"

includes linear and branched alpha olefins unless expressly stated otherwise. In the case of branched alpha olefins, a branch can be at the 2-position (a vinylidene) and/or the 3-position or higher with respect to the olefin double bond. The term "vinylidene" whenever used in this specification and claims refers to an alpha olefin having a branch at the 2-position with respect to the olefin double bond. Alpha-olefins are almost always mixtures of isomers and often also mixtures of compounds with a range of carbon numbers. Low molecular weight alpha olefins, such as the $C_6$, $C_8$, $C_{10}$, $C_{12}$ and $C_{14}$ alpha olefins, are almost exclusively 1-olefins. Higher molecular weight olefin cuts such as $C_{16}$-$C_{18}$ or $C_{20}$-$C_{24}$ have increasing proportions of the double bond isomerized to an internal or vinylidene position A "normal alpha olefin" (NAO) refers to a linear aliphatic mono-olefin having a carbon-carbon double bond between the first and second carbon atoms. It is noted that "normal alpha olefin" is not synonymous with "linear alpha olefin" as the term "linear alpha olefin" can include linear olefinic compounds having a double bond between the first and second carbon atoms.

"Isomerized olefins" or "isomerized normal alpha-olefins" refers to olefins obtained by isomerizing olefins. Generally isomerized olefins have double bonds in different positions than the starting olefins from which they are derived, and may also have different characteristics.

"TBN" means total base number as measured by ASTM D2896.

"$KV_{100}$" means kinematic viscosity at 100° C. as measured by ASTM D445.

"Pour point" is the temperature at which a sample will begin to flow under carefully controlled conditions. The pour points referred to herein were determined according to ASTM D6749.

"Basicity Index" is the molar ratio of total base to total soap in an overbased detergent.

"Overbased" is used to describe metal detergents in which the ratio of the number of equivalents of the metal moiety to the number of equivalents of the acid moiety is greater than one.

"Soap" means a neutral detergent compound that contains approximately the stoichiometric amount of metal to achieve the neutralization of the acidic group or groups present in the organic acid used to make the detergent.

"Metal" refers to alkali metals, alkaline earth metals, or mixtures thereof. When an alkali metal is employed, the alkali metal is lithium, sodium or potassium. When an alkaline earth metal is employed, the alkaline earth metal can be selected from the group consisting of calcium, barium, magnesium and strontium. Calcium and magnesium are preferred.

"Weight percent" (wt. %), unless expressly stated otherwise, means the percentage that the recited component(s), compounds(s) or substituent(s) represents of the total weight of the entire composition.

All percentages reported are weight % on an active ingredient basis (i.e., without regard to carrier or diluent oil) unless otherwise stated. The diluent oil for the lubricating oil additives can be any suitable base oil (e.g., a Group I base oil, a Group II base oil, a Group III base oil, a Group IV base oil, a Group V base oil, or a mixture thereof).

Lubricating Oil Composition

The lubricating oil composition of the present disclosure comprises (a) greater than 50 wt. % a base oil of lubricating viscosity; and (b) 0.1 to 40 wt. % of an overbased alkaline earth metal salt of an alkyl-substituted hydroxyaromatic compound, the alkyl substituent being a residue derived from an isomerized alpha-olefin having from 12 to 40 carbon atoms per molecule; wherein the lubricating oil composition is a monograde lubricating oil composition meeting specifications for SAE J300 revised January 2015 requirements for a SAE 20, 30, 40, 50, or 60 monograde engine oil, and has a TBN of 5 to 200 mg KOH/g, as determined by ASTM D2896.

The lubricating oil composition is monograde lubricating oil composition meeting specifications for SAE J300 revised January 2015 requirements for a SAE 20, 30, 40, 50, or 60 monograde engine oil. A SAE 20 oil has a kinematic viscosity at 100° C. of 6.9 to <9.3 $mm^2/s$. A SAE 30 oil has a kinematic viscosity at 100° C. of 9.3 to <12.5 $mm^2/s$. A SAE 40 oil has a kinematic viscosity at 100° C. of 12.5 to <16.3 $mm^2/s$. A SAE 50 oil has a kinematic viscosity at 100° C. of 16.3 to <21.9 $mm^2/s$. A SAE 60 oil has a kinematic viscosity at 100° C. of 21.9 to <26.1 $mm^2/s$.

In some embodiments, the lubricating oil composition is suitable for use as a marine cylinder lubricant (MCL). Marine cylinder lubricants are typically made to the SAE 30, SAE 40, SAE 50 or SAE 60 monograde specification in order to provide a sufficiently thick lubricant film at the high temperatures on the cylinder liner wall. Typically, marine diesel cylinder lubricants have a TBN ranging from 15 to 200 mg KOH/g (e.g., from 15 to 150 mg KOH/g, from 15 to 60 mg KOH/g, from 20 to 200 mg KOH/g, from 20 to 150 mg KOH/g from 20 to 120 mg KOH/g, from 20 to 80 mg KOH/g, from 30 to 200 mg KOH/g, or from 30 to 150 mg KOH/g, or from 30 to 120 mg KOH/g, from 30 to 100 mg KOH/g, from 30 to 80 mg KOH/g, from 60 to 200 mg KOH/g, from 60 to 150 mg KOH/g, from 60 to 120 mg KOH/g, from 60 to 100 mg KOH/g, from 60 to 80 mg KOH/g, from 80 to 200 mg KOH/g, from 80 to 150 mg KOH/g, from 80 to 150 mg 120 KOH/g, from 120 to 200 mg KOH/g, or from 120 to 150 mg KOH/g).

In some embodiments, the present lubricating oil composition is suitable for use as a marine system oil. Marine system oil lubricants are typically made to the SAE 20, SAE 30 or SAE 40 monograde specification. The viscosity for the marine system oil is set at such a relatively low level in part because a system oil can increase in viscosity during use and the engine designers have set viscosity increase limits to prevent operational problems. Typically, marine system oil lubricants have a TBN ranging from 5 to 12 mg KOH/g (e.g., from 5 to 10 mg KOH/g or from 5 to 9 mg KOH/g).

In some embodiments, the present lubricating oil composition is suitable for use as a marine trunk piston engine oil (TPEO). Marine TPEO lubricants are typically made to the SAE 30 or SAE 40 monograde specification. Typically, marine TPEO lubricants have a TBN ranging from 10 to 60 mg KOH/g (e.g., from 10 to 30 mg KOH/g, from 20 to 60 mg KOH/g, 20 to 40 mg KOH/g, from 30 to 60 mg KOH/g, or from 30 to 55 mg KOH/g).

Oil of Lubricating Viscosity

The oil of lubricating viscosity may be selected from any of the base oils in Groups I-V as specified in the American Petroleum Institute (API) Base Oil Interchangeability Guidelines (API 1509). The five base oil groups are summarized in Table 1:

TABLE 1

| Group | Saturates(1) | Sulfur(2) | Viscosity Index(3) |
|---|---|---|---|
| I | <90% and/or | >0.03% and | ≥80 to <120 |
| II | ≥90% and | ≤0.03% and | ≥80 to <120 |

TABLE 1-continued

| Group | Saturates[1] | Sulfur[2] | Viscosity Index[3] | |
|---|---|---|---|---|
| III | ≥90% and | ≤0.03% and | ≥120 | |
| IV | | | | Polyalphaolefins (PAO) |
| V | | | | All other base stocks not included in Groups I, II, III or IV |

[1]ASTM D2007
[2]ASTM D2270
[3]ASTM D3120, ASTM D4294, or ASTM D4297

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. Such oils may include castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene/isobutylene copolymers); poly(1-hexenes), poly(1-octenes), trimers or oligomers of 1-decene, e.g., poly(1-decenes), such materials being often referred to as α-olefins, and mixtures thereof; alkylbenzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Base oils for use in the formulated lubricating oils useful in the present disclosure are any of the variety of oils corresponding to API Group I, Group II, Group III, Group IV, and Group V oils and mixtures thereof. In one embodiment, the base oil is a Group II base oil or a blend of two or more different base oils. In another embodiment, the base oil is a Group I base oil or a blend of two or more different Group I base oils. Suitable Group I base oils include any light overhead cuts from a vacuum distillation column, such as, for example, any Light Neutral, Medium Neutral, and Heavy Neutral base stocks. The base oil may also include residual base stocks or bottoms fractions such as bright stock. Bright stock is a high viscosity base oil which has been conventionally produced from residual stocks or bottoms and has been highly refined and dewaxed. Bright stock can have a kinematic viscosity at 40° C. of greater than 180 $mm^2/s$ (e.g., greater than 250 $mm^2/s$, or even in a range of 500 to 1100 $mm^2/s$).

The base oil constitutes the major component of the lubricating oil composition of the present disclosure and is present in an amount greater than 50 wt. % (e.g., at least 60 wt. %, at least 70 wt. %, at least 80 wt. %, or at least 90 wt. %), based on the total weight of the composition. The base oil conveniently has a kinematic viscosity of 2 to 40 $mm^2/s$, as measured at 100° C.

Overbased Alkaline Earth Metal Salt of an Alkyl-Substituted Hydroxyaromatic Compound The overbased alkaline earth metal salt of an alkyl-substituted hydroxyaromatic compound of the present disclosure has a TBN, on an actives basis, of at least 100 mg KOH/g (e.g., 100 to 900 mg KOH/g, 100 to 700 mg KOH/g, 100 to 500 mg KOH/g, 100 to 400 mg KOH/g, or 100 to 300 mg KOH/g), or at least 150 mg KOH/g (e.g., 150 to 900 mg KOH/g, 150 to 500 mg KOH/g, 150 to 400 mg KOH/g, or 150 to 300 mg KOH/g), or at least 200 mg KOH/g (e.g., 200 to 900 mg KOH/g, 200 to 500 mg KOH/g, 200 to 400 mg KOH/g, or 200 to 300 mg KOH/g).

The overbased alkaline earth metal salt of an alkyl-substituted hydroxyaromatic compound of the present disclosure will be present in the lubricating oil composition in a minor amount compared to the oil of lubricating viscosity. Generally, this component is present in an amount of from 0.1 to 40 wt. % (0.1 to 30 wt. %, 0.1 to 25 wt. %, 0.1 to 20 wt. %, 0.1 to 15 wt. %, 0.1 to 10 wt. %, 0.5 to 40 wt. %, 0.5 to 30 wt. %, 0.5 to 25 wt. %, 0.5 to 20 wt. %, 0.5 to 15 wt. %, 0.5 to 10 wt. %, 1.0 to 40 wt. %, 1.0 to 30 wt. %, 1.0 to 25 wt. %, 1.0 to 20 wt. %, 1.0 to 15 wt. % 1.0 to 10 wt. %, 2.0 to 40 wt. %, 2.0 to 30 wt. %, 2.0 to 25 wt. %, 2.0 to 20 wt. %, 2.0 to 10 wt. %, 2.0 to 40 wt. %, 2.0 to 30 wt. %. 2.0 to 25 wt. %, 2.0 to 20 wt. %, 2.0 to 15 wt. %, 2.0 to 10 wt. %, 2.0 to 8 wt. %, 3.0 to 40 wt. %, 3.0 to 30 wt. %, 3.0 to 25 wt. %, 3.0 to 20 wt. %, 3.0 to 15 wt. %, 3.0 to 10 wt. %, 5.0 to 40 wt. %, 5.0 to 30 wt. %, 5.0 to 25 wt. %, 5.0 to 20 wt. %, 5.0 to 15 wt. %, or 5.0 to 10 wt. % based on the total weight of the lubricating oil composition.

Suitable alkaline earth metals include barium, calcium, and magnesium, preferably calcium.

Suitable alkyl-substituted hydroxyaromatic compounds include alkyl-substituted phenols and alkyl-substituted hydroxyaromatic carboxylic acids.

In one embodiment, the overbased alkaline earth metal salt of an alkyl-substituted hydroxyaromatic compound is an overbased isomerized normal alpha-olefin based phenate detergent.

The overbased isomerized normal alpha-olefin based phenate detergent is an alkylated hydroxyl compound wherein the alkyl substituent of the hydroxyl compound is a residue of at least one olefin having from 12 to 40 carbon atoms per molecule. The isomerized olefin can be a $C_{12}$-$C_{40}$ olefin (e.g., a $C_{14}$-$C_{28}$ olefin, a $C_{14}$-$C_{24}$ olefin, a $C_{14}$-$C_{18}$ olefin, a $C_{20}$-$C_{28}$ olefin, or a $C_{20}$-$C_{24}$ olefin).

The overbased isomerized normal alpha-olefin based phenate detergent can be prepared by the processes described in U.S. Pat. No. 8,580,717. The overbased isomerized normal alpha olefin based phenate detergent may be prepared by the following process: (a) alkylating at least one hydroxyaromatic compound with at least one isomerized olefin obtained by isomerizing at least one normal alpha olefin having from 12 to 40 carbon atoms, to provide at least one alkylated hydroxyaromatic compound; (b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound; wherein the hydroxyaromatic compound is a phenol, cresol, xylenol, or a mixture thereof.

The alkaline earth metal bases that may be used for carrying out the overbasing process include the oxides or hydroxides of calcium, magnesium, barium, or strontium, and particularly of calcium oxide, calcium hydroxide, magnesium oxide, and mixtures thereof. In one embodiment, the alkaline earth metal base is slaked lime (calcium hydroxide).

In one embodiment, the overbased alkaline earth metal salt of an alkyl-substituted hydroxyaromatic compound is an overbased alkyl-substituted hydroxyaromatic carboxylate detergent.

In one embodiment, the overbased alkaline earth metal alkyl-substituted hydroxyaromatic carboxylate of the present of disclosure is an overbased alkaline earth metal alkyl-substituted hydroxybenzoate which contains a single type of anion as a surfactant for the additive, for example, a member or members of the alkyl salicylate group, and does not contain a member or members of the sulfonate group, or a member of members of the phenate group, other than phenate that is derived from inherent phenol which is a result of the process to manufacture salicylate.

In one embodiment, the overbased alkaline earth metal alkyl-substituted hydroxyaromatic carboxylate detergent is not a complex, or hybrid, detergent which is known in the art as comprising a surfactant system derived from at least two surfactants described above.

In one embodiment, the alkaline earth metal alkyl-substituted hydroxyaromatic carboxylate can be represented by the following structure (1):

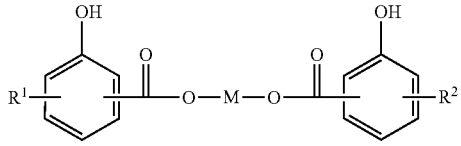

(1)

wherein (i) M independently represents an alkaline earth metal (e.g., Ba, Ca, and Mg) (ii) each carboxylate group independently may be in the ortho, meta, or para position, or mixtures thereof, relative to the hydroxyl group; and (iii) each of $R^1$ and $R^2$ is independently an alkyl substituent having from 12 to 40 carbon atoms (e.g., 14 to 28 carbon atoms, 14 to 18 carbon atoms, 18 to 30 carbon atoms, 20 to 28 carbon atoms, or 20 to 24 carbon atoms).

The alkyl substituent of the overbased alkaline earth metal alkyl-substituted hydroxyaromatic carboxylate may be a residue derived from an isomerized normal alpha-olefin having from 12 to 40 carbon atoms. In one embodiment, the alkyl substituent is a residue derived from an isomerized alpha-olefin having from 14 to 28 carbon atoms per molecule. In one embodiment, the alkyl substituent is a residue derived from an isomerized alpha-olefin having from 14 to 18 carbon atoms per molecule. In one embodiment, the alkyl substituent is a residue derived from an alpha-olefin having from 20 to 28 carbon atoms per molecule. In one embodiment, the alkyl substituent is a residue derived from an alpha-olefin having from 20 to 24 carbon atoms per molecule. In one embodiment, the alkyl substituent is a residue derived from an olefin comprising $C_{12}$ to $C_{40}$ oligomers of a monomer selected from propylene, butylene, or mixtures thereof. Examples of such olefins include propylene tetramer, butylene trimer, isobutylene oligomers, and the like. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing. The alpha-olefin may be a normal alpha-olefin, an isomerized normal alpha-olefin, or a mixture thereof.

In one embodiment where the alkyl substituent is a residue derived from an isomerized alpha-olefin, the alpha-olefin can have an isomerization level (l) of 0.1 to 0.4 (e.g., 0.1 to 0.3, or 0.1 to 0.2). The isomerization level (l) can be determined by $^1$H NMR spectroscopy and represents the relative amount of methyl groups (—$CH_3$) (chemical shift 0.30-1.01 ppm) attached to the methylene backbone groups (—$CH_2$–) (chemical shift 1.01-1.38 ppm) and is defined by the following formula:

$$l=m/(m+n)$$

where m is the $^1$H NMR integral for methyl groups with chemical shifts between 0.30±0.03 to 1.01±0.03 ppm, and n is the $^1$H NMR integral for methylene groups with chemical shifts between 1.01±0.03 to 1.38±0.10 ppm.

Overbased alkaline earth metal alkyl-substituted hydroxyaromatic carboxylates may be prepared by methods known in the art, such as described, for example, in U.S. Pat. Nos. 8,030,258 and 8,993,499.

Process for Preparing the Overbased Alkaline Earth Metal Alkyl-Substituted Hydroxyaromatic Carboxylate The overbased alkaline earth metal alkyl-substituted hydroxyaromatic carboxylate of this disclosure can be prepared by any process known to one skilled in the art for making alkyl-substituted hydroxycarboxylic acids. For example, a process for preparing an overbased alkaline earth metal alkyl-substituted hydroxyaromatic carboxylate can comprise (a) alkylating a hydroxyaromatic compound with an olefin to produce an alkyl-substituted hydroxyaromatic compound; (b) neutralizing the alkyl-substituted hydroxyaromatic compound with an alkali metal base to produce an alkali metal salt of an alkyl-substituted hydroxyaromatic compound; (c) carboxylating the alkali metal salt of an alkyl-substituted hydroxyaromatic compound with a carboxylating agent (e.g., $CO_2$) to produce an alkali metal alkyl-substituted hydroxyaromatic carboxylate; (d) acidifying the alkali metal alkyl-substituted hydroxyaromatic carboxylate with an aqueous solution of an acid strong enough to produce an alkyl-substituted hydroxyaromatic carboxylic acid; and (e) overbasing alkaline earth metal alkyl-substituted hydroxyaromatic carboxylate with a molar excess of alkaline earth metal base and at least one acidic overbasing material.

(A) Alkylation

The alkylation is carried out by charging a hydrocarbon feed comprising a hydroxyaromatic compound or a mixture of hydroxyaromatic compounds, an olefin or a mixture of olefins, and an acid catalyst to a reaction zone in which agitation is maintained. The resulting mixture is held in the alkylation zone under alkylation conditions for a time sufficient to allow substantial conversion (e.g., at least 70% mole % of the olefin has reacted) of the olefin to the hydroxyaromatic alkylate. After the desired reaction time, the reaction mixture is removed from the alkylation zone and fed to a liquid-liquid separator to allow hydrocarbon products to separate from the acid catalyst which may be recycled to the reactor in a closed loop. The hydrocarbon product may be further treated to remove excess unreacted hydroxyaromatic compounds and olefinic compounds from the desired alkylate product. The excess hydroxyaromatic compounds can also be recycled to the reactor.

Suitable hydroxyaromatic compounds include monocyclic hydroxyaromatic compounds and polycyclic hydroxyaromatics containing one or more aromatic moieties, such as one or more benzene rings, optionally fused together or otherwise connected via alkylene bridges. Exemplary hydroxyaromatic compounds include phenol, cresol, and naphthol. In one embodiment, the hydroxyaromatic compound is phenol.

The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing. In some embodiments, the olefin is a normal alpha-olefin, an isomerized normal alpha-olefin, or a mixture thereof.

In some embodiments, the olefin is a mixture of normal alpha-olefins selected from olefins having from 12 to 40 carbon atoms per molecule (e.g., 14 to 28 carbon atoms per molecule, 14 to 18 carbon atoms per molecule, 18 to 30 carbon atoms per molecule, 20 to 28 carbon atoms per molecule, 20 to 24 carbon atoms per molecule) In some embodiments, the normal alpha-olefins are isomerized using at least one of a solid or liquid catalyst.

In another embodiment, the olefins include one or more olefins comprising $C_{12}$ to $C_{40}$ oligomers of monomers selected from propylene, butylene or mixtures thereof. Generally, the one or more olefins will contain a major mount of the $C_{12}$ to $C_{40}$ oligomers of monomers selected from propylene, butylene or mixtures thereof. Examples of such olefins include propylene tetramer, butylene trimer and the like. As one skilled in the art will readily appreciate, other olefins may be present. For example, the other olefins that can be used in addition to the $C_{12}$ to $C_{40}$ oligomers include linear olefins, cyclic olefins, branched olefins other than propylene oligomers such as butylene or isobutylene oligomers, arylalkylenes and the like and mixtures thereof. Suitable linear olefins include 1-hexene, 1-nonene, 1-decene, 1-dodecene and the like and mixtures thereof. Especially suitable linear olefins are high molecular weight normal alpha-olefins such as $C_{16}$ to $C_{30}$ normal alpha-olefins, which can be obtained from processes such as ethylene oligomerization or wax cracking. Suitable cyclic olefins include cyclohexene, cyclopentene, cyclooctene and the like and mixtures thereof. Suitable branched olefins include butylene dimer or trimer or higher molecular weight isobutylene oligomers, and the like and mixtures thereof. Suitable arylalkylenes include styrene, methyl styrene, 3-phenylpropene, 2-phenyl-2-butene and the like and mixtures thereof.

Any suitable reactor configuration may be used for the reactor zone. These include batch and continuously stirred tank reactors, reactor riser configurations, and ebullating or fixed bed reactors.

The alkylation can be carried out at a temperature of from 15° C. to 200° C. and at a sufficient pressure that a substantial portion of the feed components remain in the liquid phase. Typically, a pressure of 0 to 150 psig is satisfactory to maintain feed and products in the liquid phase.

The residence time in the reactor is a time that is sufficient to convert a substantial portion of the olefin to alkylate product. The time required may be from 30 seconds to about 300 minutes. A more precise residence time may be determined by those skilled in the art using batch stirred reactors to measure the kinetics of the alkylation process.

The at least one hydroxyaromatic compound or mixture of hydroxyaromatic compounds and the mixture of olefins may be injected separately into the reaction zone or may be mixed prior to injection. Both single and multiple reaction zones may be used with the injection of the hydroxyaromatic compounds and the olefins into one, several, or all reaction zones. The reaction zones need not be maintained at the same process conditions.

The hydrocarbon feed for the alkylation process may comprise a mixture of hydroxyaromatic compounds and a mixture of olefins in which the molar ratio of hydroxyaromatic compounds to olefins is from 0.5:1 to 50:1 or more. In the case where the molar ratio of hydroxyaromatic compounds to olefins is greater than 1:1, there is an excess of hydroxyaromatic compounds present. Preferably, an excess of hydroxyaromatic compounds is used to increase reaction rate and improve product selectivity. When excess hydroxyaromatic compounds are used, the excess unreacted hydroxyaromatic compounds in the reactor effluent can be separated (e.g., by distillation) and recycled to the reactor.

Typically, the alkyl-substituted hydroxyaromatic compound comprises a mixture of mono alkyl-substituted isomers. The alkyl group of the alkyl-substituted hydroxyaromatic compound is typically attached to the hydroxyaromatic compound primarily in the ortho and para positions, relative to the hydroxyl group. In one embodiment, the alkylation product may contain 1 to 99% ortho isomer and 99 to 1% para isomer. In another embodiment, the alkylation product may contain 5 to 70% ortho and 95 to 30% para isomer.

The acidic alkylation catalyst is a strong acid catalyst such as a Brønsted or a Lewis acid. Useful strong acid catalysts include hydrofluoric acid, hydrochloric acid, hydrobromic acid, perchloric acid, nitric acid, sulfuric acid, trifluoromethane sulfonic acid, fluorosulfonic acid, AMBERLYST® 36 sulfonic acid (available from The Dow Chemical Company), nitric acid, aluminium trichloride, aluminium tribromide, boron trifluoride, antimony pentachloride, and the like and mixtures thereof. Acidic ionic liquids can be used as an alternative to the commonly used strong acid catalysts in alkylation processes.

(B) Neutralization

The alkyl-substituted hydroxyaromatic compound is neutralized with an alkali metal base (e.g., oxide or hydroxides of lithium, sodium or potassium). Neutralization may take place in the presence of a light solvent (e.g., toluene, xylene isomers, light alkylbenzene, and the like) to form an alkali metal salt of the alkyl-substituted hydroxyaromatic compound. In one embodiment, the solvent forms an azeotrope with water. In another embodiment, the solvent may be a mono-alcohol such as 2-ethylhexanol. In this case, the 2-ethylhexanol is eliminated by distillation before carboxylation. The objective with the introduction of a solvent is to facilitate the elimination of water.

The neutralization is carried out a temperature high enough to eliminate water. The neutralization may be conducted under a slight vacuum in order to require a lower reaction temperature.

In one embodiment, xylene is used as a solvent and the reaction conducted at a temperature of 130° C. to 155° C. under an absolute pressure about 80 kPa.

In another embodiment, 2-ethylhexanol is used as a solvent. As the boiling point of 2-ethylhexanol (184° C.) is significantly higher than xylene (140° C.), the neutralization is conducted at a temperature of at least 150° C.

The pressure may be reduced gradually below atmospheric pressure in order to complete the distillation of water. In one embodiment, the pressure is reduced to no more 7 kPa.

By providing that operations are carried out at a sufficiently high temperature and that the pressure in the reactor is reduced gradually below atmospheric, the formation of the alkali metal salt of an alkyl-substituted hydroxyaromatic compound is carried out without the need to add a solvent and forms an azeotrope with the water formed during this reaction. For instance, the temperature is ramped up to 200° C. and then the pressure is gradually reduced below atmospheric. Preferably, the pressure is reduced to no more than 7 kPa.

Elimination of water may occur over a period of at least 1 hour (e.g., at least 3 hours).

The quantities of reagent may correspond to the following: a molar ratio of alkali metal base to alkyl-substituted hydroxaromatic compound of from 0.5: to 1.2:1 (e.g., 0.9:1 to 1.05:1); and a wt./wt. ratio of solvent to alkyl-substituted hydroxyaromatic compound of from 0.1:1 to 5:1 (e.g., 0.3:1 to 3:1).

(C) Carboxylation

The carboxylation step is conducted by simply bubbling carbon dioxide ($CO_2$) into the reaction medium originating from the preceding neutralization step and is conducted until at least 50 mole % of the starting alkali metal salt of an alkyl-substituted hydroxyaromatic compound is converted to an alkali metal alkyl-substituted hydroxyaromatic carboxylate (measured as hydroxybenzoic acid by potentiometric determination).

At least 50 mole % (e.g., at least 75 mole %, or even at least 85 mole %) of the starting the alkali metal salt of an alkyl-substituted hydroxyaromatic compound is converted to an alkali metal alkyl-substituted hydroxyaromatic carboxylate using $CO_2$ at a temperature from 110° C. to 200° C. under a pressure of from 0.1 to 1.5 MPa, for a period between 1 and 8 hours.

In one variant with a potassium salt, the temperature may be from 125° C. to 165° C. (e.g., 130° C. to 155° C.) and the pressure may be from 0.1 to 1.5 MPa (e.g., 0.1 to 0.4 MPa).

In another variant with a sodium salt, the temperature is directionally lower and may be from 110° C. to 155° C. (e.g., 120° C. to 140° C.) and the pressure may be from 0.1 to 2.0 MPa (e.g., 0.3 to 1.5 MPa).

The carboxylation is usually carried out in a diluent such as hydrocarbons or alkylate (e.g., benzene, toluene, xylene, and the like). In this case, the weight ratio of solvent to the alkali metal salt of the alkyl-substituted hydroxyaromatic compound may range from 0.1:1 to 5:1 (e.g., 0.3:1 to 3:1).

In another variant, no solvent is used. In this case, carboxylation is conducted in the presence of diluent oil in order to avoid a too viscous material. The weight ratio of diluent oil to the alkali metal salt of the alkyl-substituted hydroxyaromatic compound may range from 0.1:1 to 2:1 (e.g., from 0.2:1 to 1:1, or from 0.2:1 to 0.5:1).

(D) Acidification

The alkali metal alkyl-substituted hydroxyaromatic carboxylate produced above is then contacted with at least one acid capable of converting the alkali metal alkyl-substituted hydroxyaromatic carboxylate to an alkyl-substituted hydroxyaromatic carboxylic acid. Such acids are well known in the art to acidify the aforementioned alkali metal salt. Usually hydrochloric acid or aqueous sulfuric acid is utilized.

(E) Overbasing

Overbasing of the alkylated hydroxyaromatic carboxylic acid may be carried out by any method known by a person skilled in the art to produce an overbased alkaline earth metal alkyl-substituted hydroxyaromatic carboxylate detergent.

In one embodiment, the overbasing reaction is carried out in a reactor by reacting the alkylated hydroxyaromatic carboxylic acid with lime (i.e., alkaline earth metal hydroxide) in the presence of carbon dioxide, an aromatic solvent (e.g., xylene), and a hydrocarbyl alcohol (e.g. methanol).

The degree of overbasing may be controlled by the quantity of the alkaline earth metal hydroxide, carbon dioxide and the reactants added to the reaction mixture and the reaction conditions used during the carbonation process.

The weight ratios of reagents used (methanol, xylene, slaked lime and $CO_2$) may correspond to the following weight ratios: xylene to slaked lime from 1.5:1 to 7:1 (e.g., from 2:1 to 4:1); methanol to slaked lime from 0.25:1 to 4:1 (e.g., from 0.4:1 to 1.2:1); $CO_2$ to slaked lime in a molar ratio of from 0.5:1 to 1.3:1 (e.g., from 0.7:1 to 1.0:1); $C_1$-$C_4$ carboxylic acid to alkaline metal base alkylhydroxyaromatic carboxylate in a molar ratio of from 0.02:1 to 1.5:1 (e.g., 0.1:1 to 0.7:1).

Lime is added as a slurry (i.e., as a pre-mixture of lime, methanol, xylene) and $CO_2$ is introduced over a period of 1 hour to 4 hours, at a temperature between 20° C. and 65° C.

Optionally, for each of the processes described above, predistillation, centrifugation and distillation may be utilized to remove solvent and crude sediment. Water, methanol and a portion of the xylene may be eliminated by heating between 110° C. and 134° C. This may be followed by centrifugation to eliminate unreacted lime. Finally, xylene may be eliminated by heating under vacuum in order to reach a flash point of at least about 160° C. as determined with the Pensky-Martens Closed Cup (PMCC) Tester described in ASTM D93.

Other Performance Additives

The formulated lubricating oil of the present disclosure may additionally contain one or more of the other commonly used lubricating oil performance additives. Such optional components may include detergents (e.g., metal detergents), dispersants, antiwear agents, antioxidants, friction modifiers, corrosion inhibitors, rust inhibitors, demulsifiers, foam inhibitors, viscosity modifiers, pour point depressants, nonionic surfactants, thickeners, and the like. Some are discussed in further detail below.

Detergents

In addition to the overbased alkaline earth metal salt of an alkyl-substituted hydroxyaromatic compound which is an essential component in the present disclosure, other detergents may also be present.

A detergent is an additive that reduces formation of piston deposits, for example high-temperature varnish and lacquer deposits in engines; it normally has acid-neutralizing properties and is capable of keeping finely-divided solids in suspension. Most detergents are based on metal "soaps", that is metal salts of acidic organic compounds.

Detergents generally comprise a polar head with a long hydrophobic tail, the polar head comprising the metal salt of the acidic organic compound. The salts may contain a substantially stoichiometric amount of the metal when they are usually described as normal or neutral salts and would typically have a TBN at 100% active mass of from 0 to <100 mg KOH/g. Large amounts of a metal base can be included by reaction of an excess of a metal compound, such as an oxide or hydroxide, with an acidic gas such as carbon dioxide.

The resulting overbased detergent comprises neutralized detergent as an outer layer of a metal base (e.g., carbonate) micelle. Such overbased detergents may have a TBN at 100% active mass of 100 mg KOH/g or greater (e.g., 200 to 500 mg KOH/g or more).

Suitably, other detergents that may be used include oil-soluble neutral and overbased sulfonates, phenates, sulfurized phenates, thiophosphonates, salicylates and naphthenates and other oil-soluble carboxylates of a metal, particularly alkali metal or alkaline earth metals (e.g., Li, Na, K, Ca and Mg). The most commonly used metals are Ca and Mg, which may both be present in detergents used in lubricating compositions, and mixtures of Ca and/or Mg with Na. Detergents may be used in various combinations.

Other detergents can be present at 0.5 to 30 wt. % of the lubricating oil composition.

Dispersants

During engine operation, oil-insoluble oxidation by-products are produced. Dispersants help keep these by-products in solution, thus diminishing their deposition on metal surfaces. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in a range of 500 to 5000 Daltons (e.g., 900 to 2500 Daltons). Succinimide dispersants and their preparation are disclosed, for instance in U.S. Pat. Nos. 4,234,435 and 7,897,696. Succinimide dispersants are typically an imide formed from a polyamine, typically a poly(ethyleneamine).

In some embodiments the lubricant composition comprises at least one polyisobutylene succinimide dispersant derived from polyisobutylene with number average molecular weight in the range of 500 to 5000 Daltons (e.g., 900 to 2500 Daltons). The polyisobutylene succinimide may be used alone or in combination with other dispersants.

The dispersant may also be post-treated by conventional methods by reaction with any of a variety of agents. Among these agents are boron compounds (e.g., boric acid) and cyclic carbonates (ethylene carbonate).

Another class of dispersants includes Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

Another class of dispersant includes high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of dispersants includes high molecular weight ester amides.

The dispersant can be present at 0.1 to 10 wt. % of the lubricating oil composition.

Antiwear Agents

Anti-wear agents reduce friction and excessive wear and are usually based on compounds containing sulfur or phosphorous or both. Noteworthy are dihydrocarbyl dithiophosphate metal salts wherein the metal may be an alkali or alkaline earth metal, or aluminium, lead, tin, molybdenum, manganese, nickel, copper, or zinc. Zinc dihydrocarbyl dithiophosphates (ZDDP) are oil-soluble salts of dihydrocarbyl dithiophosphoric acids and may be represented by the following formula:

$$Zn[SP(S)(OR)(OR')]_2$$

wherein R and R' may be the same or different hydrocarbyl radicals containing from 1 to 18 (e.g., 2 to 12) carbon atoms. To obtain oil solubility, the total number of carbon atoms (i.e., R and R') in the dithiophosphoric acid will generally be 5 or greater.

The antiwear agent can be present at 0.1 to 6 wt. % of the lubricating oil composition.

Antioxidants

Antioxidants retard the oxidative degradation of base oils during service. Such degradation may result in deposits on metal surfaces, the presence of sludge, or a viscosity increase in the lubricant.

Useful antioxidants include hindered phenols. Hindered phenol antioxidants often contain a secondary butyl and/or a tertiary butyl group as a sterically hindering group. The phenol group may be further substituted with a hydrocarbyl group (typically linear or branched alkyl) and/or a bridging group linking to a second aromatic group. Examples of hindered phenol antioxidants include 2,6-di-tert-butylphenol, 2,6-di-tert-butylcresol, 2,4,6-tri-tert-butylphenol, 2,6-di-alkyl-phenolic propionic ester derivatives, and bisphenols such as 4,4'-bis(2,6-di-tert-butylphenol) and 4,4'-methylene-bis(2,6-di-tert-butylphenol).

Sulfurized alkylphenols and alkali and alkaline earth metal salts thereof are also useful as antioxidants.

Non-phenolic antioxidants which may be used include aromatic amine antioxidants such as diarylamines and alkylated diarylamines. Particular examples of aromatic amine antioxidants include phenyl-α-naphthylamine, 4,4'-dioctyldiphenylamine, butylated/octylated diphenylamine, nonylated diphenylamine, and octylated phenyl-α-naphthylamine.

The antioxidant can be present at 0.01 to 5 wt. % of the lubricating oil composition.

Friction Modifiers

A friction modifier is any material that can alter the coefficient of friction of a surface lubricated by any lubricant or fluid containing such material. Suitable friction modifiers may include fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, and condensation products of carboxylic acids and polyalkylene-polyamines. As used herein, the term "fatty" in relation to friction modifiers means a carbon chain having 10 to 22 carbon atoms, typically a straight carbon chain. Molybdenum compounds are also known as friction modifiers. The friction modifier can be present at 0.01 to 5 wt. % of the lubricating oil composition.

Rust Inhibitors

Rust inhibitors generally protect lubricated metal surfaces against chemical attack by water or other contaminants. Suitable rust inhibitors may include nonionic suitable rust inhibitors include nonionic polyoxyalkylene agents (e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate); stearic acid and other fatty acids; dicarboxylic acids; metal soaps; fatty acid amine salts; metal salts of heavy sulfonic acid; partial carboxylic acid esters of polyhydric alcohols; phosphoric esters; (short-chain) alkenyl succinic acids, partial esters thereof and nitrogen-containing derivatives thereof; and synthetic alkarylsulfonates (e.g., metal dinonylnaphthalene sulfonates). Such additives can be present at 0.01 to 5 wt. % of the lubricating oil composition.

Demulsifiers

Demulsifiers promote oil-water separation in lubricating oil compositions exposed to water or steam. Suitable demulsifiers include trialkyl phosphates, and various polymers and copolymers of ethylene glycol, ethylene oxide, propylene oxide, or mixtures thereof. Such additives can be present at 0.01 to 5 wt. % of the lubricating oil composition.

Foam Inhibitors

Foam inhibitors retard the formation of stable foams. Silicones and organic polymers are typical foam inhibitors. For example, polysiloxanes, such as silicon oil, or polydimethylsiloxane, provide foam inhibiting properties. Further foam inhibitors include copolymers of ethyl acrylate and 2-ethylhexyl acrylate and optionally vinyl acetate. Such additives can be present at 0.001 to 1 wt. % of the lubricating oil composition.

Viscosity Modifiers

Viscosity modifiers provide lubricants with high and low temperature operability. These additives impart shear stability at elevated temperatures and acceptable viscosity at low temperatures. Suitable viscosity modifier may include polyolefins, olefin copolymers (OCP), ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, and hydrogenated alkenyl aryl conjugated diene copolymers. Such additives can be present at 0.1 to 15 wt. % of the lubricating oil composition.

Pour Point Depressants

Pour point depressants lower the minimum temperature at which a fluid will flow or can be poured. Examples of suitable pour point depressants include polymethacrylates, polyacrylates, polyacrylamides, condensation products of haloparaffin waxes and aromatic compounds, vinyl carboxylate polymers, and terpolymers of dialkylfumarates, vinyl esters of fatty acids and allyl vinyl ethers. Such additives can be present at 0.01 to 1.0 wt. % of the lubricating oil composition.

Non-ionic Surfactants

Non-ionic surfactants such as alkylphenol may improve asphaltene handling during engine operation. Examples of such materials include alkylphenol having an alkyl substituent from a straight chain or branched alkyl group having from 9 to 30 carbon atoms. Other examples include alkyl benzenol, alkylnaphthol and alkyl phenol aldehyde condensates where the aldehyde is formaldehyde such that the condensate is a methylene-bridged alkylphenol. Such additives can be present at 0.1 to 20 wt. % of the lubricating oil composition.

Thickeners

Thickeners such as polyisobutylene (PIB) and polyisobutenyl succinic anhydride (PIBSA) can be used to thicken lubricants. PIB and PIBSA are commercially available materials from several manufacturers. The PIB can be used in the manufacture of PIBSA and is typically a viscous oil-miscible liquid, having a weight average molecular weight in the range of 1000 to 8000 Daltons (e.g., 1500 to 6000 Daltons) and a kinematic viscosity at 100° C. in a range of 2000 to 6,000 $mm^2/s$. can be present at 1 to 20 wt. % of the lubricating oil composition.

Use of the Lubricating Oil Composition

The lubricant compositions may be effective as engine oil or crankcase lubricating oils for compression-ignited internal combustion engines, including marine diesel engines, stationary gas engines, and the like.

The internal combustion engine may be a 2-stroke or 4-stroke engine.

In an embodiment, the internal combustion engine is a marine diesel engine. The marine diesel engine may be a medium-speed 4-stroke compression-ignited engine having a speed of 250 to 1100 rpm or a low-speed crosshead 2-stroke compression-ignited engine having a speed of 200 rpm or less (e.g., 60 to 200 rpm).

The marine diesel engine may be lubricated with a marine diesel cylinder lubricant (typically in a 2-stroke engine), a system oil (typically in a 2-stroke engine), or a crankcase lubricant (typically a 4-stroke engine).

The term "marine" does not restrict the engines to those used in water-borne vessels; as is understood in the art, it also includes those for other industrial applications such as auxiliary power generation for main propulsion and stationary land-based engines for power generation.

In some embodiments, the internal combustion engine may be fueled with a residual fuel, a marine residual fuel, a low sulfur marine residual fuel, a marine distillate fuel, a low sulfur marine distillate fuel, or a high sulfur fuel.

A "residual fuel" refers to a material combustible in large marine engines which has a carbon residue, as determined by ISO 10370:2014, of at least 2.5 wt. % (e.g., at least 5 wt. %, or at least 8 wt. %), a viscosity at 50° C. of greater than 14.0 $mm^2/s$, such as the marine residual fuels defined in ISO 8217:2017 ("Petroleum products—Fuels (class F)—Specifications of marine fuels"). Residual fuels are primarily the non-boiling fractions of crude oil distillation. Depending on the pressures and temperatures in refinery distillation processes, and the types of crude oils, slightly more or less gas oil that could be boiled off is left in the non-boiling fraction, creating different grades of residual fuels.

A "marine residual fuel" is a fuel meeting the specification of a marine residual fuel as set forth in ISO 8217:2017. A "low sulfur marine residual fuel" is a fuel meeting the specification of a marine residual fuel as set forth in ISO 8217:2017 that, in addition, has 1.5 wt. % or less, or even 0.5 wt. % or less, of sulfur, relative to the total weight of the fuel, wherein the fuel is a residual product of a distillation process.

Distillate fuel is composed of petroleum fractions of crude oil that are separated in a refinery by a boiling or "distillation" process. A "marine distillate fuel" is a fuel meeting the specification of a marine distillate fuel as set forth in ISO 8217:2017. A "low sulfur marine distillate fuel" is a fuel meeting the specification of a marine distillate fuel as set forth in ISO 8217:2017 that, in addition, has about 0.1 wt. % of less, 0.05 wt. % or less, or even 0.005 wt. % or less of sulfur, relative to the total weight of the fuel, wherein the fuel is a distillation cut of a distillation process.

A "high sulfur fuel" is a fuel having greater than 1.5 wt. % of sulfur, relative to the total weight of the fuel.

The internal combustion engine can also be operable with a "gaseous fuel" such as a methane-dominated fuel (e.g., natural gas), a biogas, a gasified liquefied gas, or a gasified liquefied natural gas (LNG).

EXAMPLES

The following illustrative examples are intended to be non-limiting.

Test Methods

Deposit control is measured by the Komatsu Hot Tube (KHT) test, which employs heated glass tubes through which sample lubricant is pumped, approximately 5 mL total sample, typically at 0.31 mL/hour for an extended period of time, such as 16 hours, with an air flow of 10 mL/minute. The glass tube is rated at the end of test for deposits on a scale of 1.0 (very heavy varnish) to 10 (no varnish). Test results are reported in multiples of 0.5. In the case the glass tubes are completely blocked with deposits, the test result is recorded as "blocked". Blockage is deposition below a 1.0 result, in which case the lacquer is very thick and dark but still allows fluid flow. The test is run at 310° C. and 325° C. and is described in SAE Technical Paper 840262. Low temperature performance of the lubricants was evaluated by pour point, according to ASTM D6749.

Detergents

Table 2 provides a summary of properties of the carboxylate detergents used in the examples below.

TABLE 2

| Carboxylate Detergent | Alkyl-Substituent Source | TBN (as received), mg KOH/g | TBN (actives), mg KOH/g | Basicity Index | Ca Content, wt. % |
|---|---|---|---|---|---|
| A | $C_{20}$-$C_{28}$ NAO | 150 | 230 | 2.4 | 5.35 |
| B | Isomerized $C_{20}$-$C_{24}$ NAO | 420 | 620 | 9.4 | 15.0 |
| C | Isomerized $C_{20}$-$C_{24}$NAO[(1)] | 180 | 225 | 2.4 | 6.4 |
| D | Isomerized $C_{20}$-$C_{24}$ NAO[(1)]/ propylene tetramer | 140 | 210 | 1.4 | 5.0 |
| E | $C_{20}$-$C_{28}$ NAO/ propylene tetramer | 140 | 210 | 1.4 | 5.0 |
| F | $C_{20}$-$C_{28}$ NAO | 350 | 520 | 7.2 | 12.5 |

[(1)]Isomerization Level = 0.16

Example 1 and Comparative Example A

A series of 6 BN marine system oil lubricants were formulated with Group I base oil, an overbased calcium alkyl-substituted hydroxyaromatic carboxylate detergent, an aminic antioxidant and a zinc dialkyldithiophosphate (ZDDP). The low temperature properties of the lubricants were evaluated and are summarized in Table 3. Weight percentages reported for the additives in Table 3 are on an as-received basis.

TABLE 3

| | Ex. 1 | Comp. Ex. A |
|---|---|---|
| Components | | |
| Carboxylate Detergent A, wt. % | — | 4.00 |
| Carboxylate Detergent C, wt. % | 3.16 | — |
| Antioxidant, wt. % | 0.50 | 0.50 |
| ZDDP, wt. % | 0.70 | 0.70 |
| 150N Group I Base Oil, wt. % | 3.46 | 4.14 |
| 600N Group I Base Oil, wt. % | 92.18 | 90.66 |
| Lubricant Properties | | |
| TBN, mg KOH/g | 6.5 | 6.8 |
| $KV_{100}$, $mm^2/s$ | 12.05 | 12.01 |
| Ca, wt. % | 0.24 | 0.25 |
| P, ppm | 571 | 579 |
| Zn, ppm | 666 | 679 |
| Pour Point, ° C. | −30 | −12 |

Example 2 and Comparative Example B

A series of marine 15 BN TPEO lubricants were formulated with Group 11 base oil, an overbased calcium alkyl-substituted hydroxyaromatic carboxylate detergent, an overbased calcium branched-chain alkylphenate detergent derived from propylene tetramer, an ashless dispersant, a viscosity index improver (VII), a demulsifier and a ZDDP. The low temperature properties of the lubricants were evaluated and are summarized in Table 4. Weight percentages reported for the additives in Table 4 are on an as-received basis.

TABLE 4

| | Ex. 2 | Comp. Ex. B |
|---|---|---|
| Components | | |
| Carboxylate Detergent A, wt. % | — | 8.47 |
| Carboxylate Detergent C, wt. % | 6.68 | — |
| Ca Phenate Detergent, wt. % | 2.00 | 2.00 |
| Dispersant, wt. % | 2.00 | 2.00 |
| Demulsifier, wt. % | 0.05 | 0.05 |
| ZDDP, wt. % | 0.70 | 0.70 |
| 24 SSI OCP VII | 2.00 | 2.00 |
| 600R Group II Base Oil, wt. % | 81.69 | 78.50 |
| 150N Group I Base Oil, wt. % | 4.88 | 6.28 |
| Lubricant Properties | | |
| TBN, mg KOH/g | 14.7 | 15.5 |
| $KV_{100}$, $mm^2/s$ | 14.93 | 15.02 |
| Ca, wt. % | 0.56 | 0.58 |
| P, ppm | 576 | 559 |
| Zn, ppm | 597 | 580 |
| Pour Point, ° C. | −30 | −12 |

Example 3 and Comparable Example C

A series of 15 BN marine cylinder lubricants were formulated with Group I base oil, a combination of overbased calcium alkyl-substituted hydroxyaromatic carboxylate detergents, an ashless dispersant and a PIB thickener. The low temperature properties of the lubricants were evaluated and are summarized in Table 5. Weight percentages reported for the additives in Table 5 are on an as-received basis.

TABLE 5

| | Ex. 3 | Comp. Ex. C |
|---|---|---|
| Components | | |
| Carboxylate Detergent A, wt. % | — | 3.95 |
| Carboxylate Detergent B, wt. % | 1.76 | 1.76 |
| Carboxylate Detergent C, wt. % | 4.05 | — |
| Dispersant, wt. % | 4.00 | 4.00 |
| 1000 MW PIB, wt. % | 4.00 | 4.00 |
| 600N Group I Base Oil, wt. % | 71.06 | 71.16 |
| Bright Stock, wt. % | 15.12 | 15.13 |
| Lubricant Properties | | |
| TBN, mg KOH/g | 15.0 | 13.5 |
| $KV_{100}$, $mm^2/s$ | 19.35 | 19.14 |
| Ca, wt. % | 0.60 | 0.55 |
| Pour Point, ° C. | −27 | −18 |

Examples 4-5 and Comparative Example D

A series of 40 BN TPEO lubricants were formulated with Group I base oil, a combination of overbased calcium alkyl-substituted hydroxyaromatic carboxylate detergents, a demulsifier, ZDDP, and a $C_{20}$-$C_{24}$ alkylphenol non-ionic surfactant derived from isomerized olefins.

The low temperature properties, deposit control performance, and oxidative stability of the lubricants were evaluated. The results are summarized in Table 6. Weight percentages reported for the additives in Table 6 are on an as-received basis.

TABLE 6

| | Ex. 4 | Ex. 5 | Comp. Ex. D |
|---|---|---|---|
| Components | | | |
| Carboxylate Detergent B, wt. % | 7.06 | 7.06 | 7.06 |
| Carboxylate Detergent C, wt. % | 5.26 | — | — |
| Carboxylate Detergent D, wt. % | — | 7.14 | — |
| Carboxylate Detergent E, wt. % | — | — | 7.14 |
| Demulsifier, wt. % | 0.05 | 0.05 | 0.05 |
| ZDDP, wt. % | 0.70 | 0.70 | 0.70 |
| $C_{20}$-$C_{24}$ alkylphenol, wt. % | 2.00 | 2.00 | 2.00 |
| 600N Group I Base Oil, wt. % | 77.28 | 77.17 | 77.95 |
| Bright Stock, wt. % | 7.65 | 5.88 | 3.10 |
| Lubricant Properties | | | |
| TBN, mg KOH/g | 39.7 | 40.0 | 39.3 |
| $KV_{100}$, $mm^2/s$ | 14.02 | 14.45 | 14.01 |
| Ca, wt. % | 1.53 | 1.53 | 1.54 |
| P, ppm | 580 | 569 | 571 |
| Zn, ppm | 632 | 618 | 621 |
| Pour Point, ° C. | −21 | −21 | −12 |

Examples 6-7 and Comparative Examples E-F

A series of 70 BN marine cylinder lubricants were formulated with Group I or Group 11 base oil, an overbased calcium alkyl-substituted hydroxyaromatic carboxylate detergent, an overbased sulfurized calcium alkylphenate detergent derived either from propylene tetramer or isomerized $C_{20}$-$C_{24}$ olefins, an ashless dispersant, a thickener, and, optionally, an overbased calcium sulfonate detergent, a ZDDP and a VII. The low temperature properties of the lubricants were evaluated and are summarized in Table 7. Weight percentages reported for the additives in Table 7 are on an as-received basis.

TABLE 7

| | Ex. 6 | Comp. Ex. E | Ex. 7 | Comp. Ex. F |
|---|---|---|---|---|
| Components | | | | |
| Carboxylate Detergent A, wt. % | — | 10.00 | — | — |
| Carboxylate Detergent C, wt. % | 7.89 | — | — | — |
| Carboxylate Detergent D, wt. % | — | — | 10.71 | — |
| Carboxylate Detergent E, wt. % | — | — | — | 10.71 |
| Ca Alkylphenate (propylene tetramer) Detergent, wt. % | — | 20.91 | — | — |
| Ca Alkylphenate (isomerized $C_{20}$-$C_{24}$ NAO) Detergent, wt. % | 20.91 | — | — | — |
| Ca Sulfonate Detergent, wt. % | — | — | 12.94 | 12.94 |
| Dispersant, wt. % | 0.50 | 0.50 | 0.50 | 0.50 |
| ZDDP, wt. % | 0.70 | 0.70 | — | — |
| 50 SSI OCP VII, wt. % | 2.00 | 2.00 | — | — |
| 2300 MW PIB Thickener, wt. % | 2.00 | 2.00 | — | — |
| 1000 MW PIBSA Thickener, wt. % | — | — | 4.00 | 4.00 |
| 600R Group II Base Oil, wt. % | — | — | 67.82 | 67.14 |

TABLE 7-continued

| | Ex. 6 | Comp. Ex. E | Ex. 7 | Comp. Ex. F |
|---|---|---|---|---|
| 600N Group I Base Oil, wt. % | 65.99 | 59.37 | — | — |
| Bright Stock, wt. % | — | 4.52 | — | — |
| Lubricant Properties | | | | |
| TBN, mg KOH/g | 66.4 | 70.2 | 68.8 | 70.2 |
| $KV_{100}$, $mm^2/s$ | 19.97 | 19.45 | 19.32 | 19.95 |
| Ca, wt. % | 2.70 | 2.76 | 2.79 | 2.86 |
| Pour Point, ° C. | −27 | −15 | −33 | −24 |

Example 8 and Comparative Example G

A series of 140 BN marine cylinder lubricants were formulated with Group II base oil, an overbased calcium alkyl-substituted hydroxyaromatic carboxylate detergent, an overbased sulfurized calcium phenate detergent, an overbased calcium sulfonate detergent, and an ashless dispersant. The low temperature properties of the lubricants were evaluated and are summarized in Table 8. Weight percentages reported for the additives in Table 8 are on an as-received basis.

TABLE 8

| | Ex. 8 | Comp. Ex. G |
|---|---|---|
| Components | | |
| Carboxylate Detergent D, wt. % | 10.71 | — |
| Carboxylate Detergent E, wt. % | — | 10.71 |
| Ca Alkylphenate Detergent, wt. % | 4.00 | 4.00 |
| Ca Sulfonate Detergent, wt. % | 28.33 | 28.33 |
| Dispersant, wt. % | 4.00 | 4.00 |
| 600R Group II Base Oil, wt. % | 52.96 | 52.96 |
| Lubricant Properties | | |
| TBN, mg KOH/g | 137.0 | 138.0 |
| $KV_{100}$, $mm^2/s$ | 27.12 | 27.58 |
| Pour Point, ° C. | −24 | −12 |

Example 9 and Comparative Example H

A series of 200 BN marine cylinder lubricants were formulated with Group I base oil, an overbased calcium alkyl-substituted hydroxyaromatic carboxylate detergent, an overbased calcium sulfonate detergent, and an ashless dispersant. The low temperature properties of the lubricants were evaluated and are summarized in Table 9. Weight percentages reported for the additives in Table 9 are on an as-received basis.

TABLE 9

| | Ex. 9 | Comp. Ex. H |
|---|---|---|
| Components | | |
| Carboxylate Detergent A, wt. % | — | 16.67 |
| Carboxylate Detergent C, wt. % | 13.16 | — |
| Ca Sulfonate Detergent, wt. % | 41.18 | 41.18 |
| Dispersant, wt. % | 4.00 | 4.00 |
| 150N Group I Base Oil, wt. % | 11.04 | 23.69 |

TABLE 9-continued

| | Ex. 9 | Comp. Ex. H |
|---|---|---|
| Lubricant Properties | | |
| TBN, mg KOH/g | 195.0 | 197.0 |
| $KV_{100}$, $mm^2/s$ | 21.82 | 26.45 |
| Pour Point, ° C. | −18 | −9 |

Example 10 and Comparative Example I

A series of 40 BN TPEO lubricants were formulated with Group I base oil, at least one overbased calcium alkyl-substituted hydroxyaromatic carboxylate detergent, and a ZDDP. The low temperature properties, deposit control performance, and oxidative stability of the lubricants were evaluated. The results are summarized in Table 10. Weight percentages reported for the additives in Table 10 are on an as-received basis.

TABLE 10

| | Ex. 10 | Comp. Ex. I |
|---|---|---|
| Components | | |
| Carboxylate Detergent F, wt. % | — | 11.43 |
| Carboxylate Detergent B, wt. % | 9.41 | — |
| ZDDP, wt. % | 0.70 | 0.70 |
| 600N Group I Base Oil, wt. % | 77.74 | 77.62 |
| Bright Stock, wt. % | 12.15 | 10.25 |
| Lubricant Properties | | |
| TBN, mg KOH/g | 39.7 | 40.2 |
| $KV_{100}$, $mm^2/s$ | 14.27 | 14.48 |
| Ca, wt. % | 1.68 | 1.57 |
| P, ppm | 580 | 535 |
| Zn, ppm | 594 | 547 |
| Test Results | | |
| Pour Point, ° C. | −22 | −10 |
| KHT (310° C.), rating | 6.5 | 5.5 |

The invention claimed is:

1. A method for improving low temperature performance of a lubricant in a compression-ignited internal combustion engine, the method comprising operating the engine with a lubricating oil composition comprising (a) greater than 50 wt. % of a base oil of lubricating viscosity; and (b) 3.0 to 40 wt. % of an overbased alkaline earth metal salt of an alkyl-substituted hydroxyaromatic compound, wherein the alkyl substituent is a residue derived from an isomerized alpha-olefin having from 20-24 carbon atoms per molecule, wherein the isomerized alpha-olefin has an isomerization level of 0.1 to 0.4, wherein the isomerization level is a relative amount of methyl groups attached to methylene backbone groups as determined by $^1H$ NMR spectroscopy; wherein the lubricating oil composition is a monograde lubricating oil composition meeting specifications for SAE J300 revised January 2015 requirements for a SAE 20, 30, 40, 50, or 60 monograde engine oil, and has a TBN of 5 to 200 mg KOH/g, as determined by ASTM D2896.

2. The method of claim 1, wherein the alkyl-substituted hydroxyaromatic compound is an alkyl-substituted phenol, an alkyl-substituted hydroxyaromatic carboxylic acid, or a combination thereof.

3. The method of claim 1, wherein the isomerized alpha-olefin is an isomerized normal alpha-olefin.

4. The method of claim 1, wherein the overbased alkaline earth metal salt of an alkyl-substituted hydroxyaromatic compound has a TBN, on an actives basis, of 100 to 500 mg KOH/g.

5. The lubricating oil composition of claim 1, wherein the lubricating oil composition has a TBN 5 to 100 mg KOH/g.

6. The method of claim 1, wherein the lubricating oil composition further comprises one or more of other detergents, a dispersant, an antiwear agent, an antioxidant, a friction modifier, a corrosion inhibitor, a rust inhibitor, a demulsifier, a foam inhibitor, a viscosity modifier, a pour point depressant, a non-ionic surfactant, and a thickener.

7. The method of claim 1, wherein the compression-ignited internal combustion engine is a 4-stroke engine operated at 250 to 1100 rpm.

8. The method of claim 1, wherein the compression-ignited internal combustion engine is a 2-stroke engine operated at 200 rpm or less.

9. The method of claim 1, wherein the compression-ignited internal combustion engine is fueled with a residual fuel, a marine residual fuel, a low sulfur marine residual fuel, a marine distillate fuel, a low sulfur marine distillate fuel, a high sulfur fuel, or a gaseous fuel.

10. The method of claim 1, wherein low temperature performance is measured according to ASTM D6749.

11. The method of claim 1, wherein the overbased alkaline earth metal salt of an alkyl-substituted hydroxyaromatic compound is not a hybrid detergent.

12. The method of claim 1, wherein the overbased alkaline earth metal salt of an alkyl-substituted hydroxyaromatic compound contains a single type of anion as a surfactant for the additive.

* * * * *